US006189151B1

(12) United States Patent
Curtis

(10) Patent No.: US 6,189,151 B1
(45) Date of Patent: Feb. 20, 2001

(54) ABSORBENT BAND

(76) Inventor: Florence Curtis, 5815 Bendixon Road, Prince George, British Columbia (CA), V2N 5V4

( * ) Notice: Under 35 U.S.C. 154(b), the term of this patent shall be extended for 0 days.

(21) Appl. No.: 09/391,506

(22) Filed: Sep. 8, 1999

Related U.S. Application Data

(60) Provisional application No. 60/113,960, filed on Dec. 28, 1998.

(51) Int. Cl.[7] ..... A42B 1/00
(52) U.S. Cl. ..... 2/171; 2/DIG. 11; 132/202
(58) Field of Search ..... 2/171, DIG. 11, 2/181; 132/202

(56) References Cited

U.S. PATENT DOCUMENTS

| | | | | |
|---|---|---|---|---|
| 1,434,854 | * | 11/1922 | Stall | 2/171 |
| 2,016,210 | * | 10/1935 | Mann | 2/171 |
| 2,996,724 | * | 8/1961 | Rose et al. | 2/181 |
| 3,050,071 | | 8/1962 | Hall . | |
| 3,388,708 | | 6/1968 | Hudson . | |
| 4,368,545 | | 1/1983 | Seidman | 2/174 |
| 4,441,214 | | 4/1984 | Werner et al. | 2/174 |
| 4,481,680 | | 11/1984 | Mason et al. | 2/174 |
| 4,656,671 | | 4/1987 | Manges | 2/174 |
| 4,958,385 | | 9/1990 | Rushton, Jr. | 2/174 |
| 5,133,371 | | 7/1992 | Sivess | 132/212 |
| 5,175,887 | | 1/1993 | Kim | 2/174 |
| 5,305,470 | * | 4/1994 | McKay | 2/7 |
| 5,377,360 | * | 1/1995 | Fleitman | 2/181 |

FOREIGN PATENT DOCUMENTS

| | | | |
|---|---|---|---|
| 2013179 | 9/1990 | (CA) | A42B/1/00 |
| 1309921 | 11/1992 | (CA) | A45D/6/00 |
| 1311913 | 12/1992 | (CA) | A61F/15/00 |
| 2108345 | 10/1995 | (CA) | A45D/6/00 |

* cited by examiner

*Primary Examiner*—Bibhu Mohanty
(74) *Attorney, Agent, or Firm*—Anthony C. Edwards

(57) ABSTRACT

A headband has an outer, substantially non-resilient, elongate, flexible sleeve. The sleeve is fluid permeable and includes an elongate central portion sized to fit around a user's head in snug circumferential frictional engagement around the user's forehead and nape so as to extend therebetween. The central portion is disposed between opposite elongate end portions. A volume of a wicking fibre fill is mounted into the central portion so as to completely fill the central portion. The fibre fill is resiliently compressed within the central portion thereby forming the volume into a dense resilient, porous cushion. The wicking fibres of the fibre fill register in fluid transporting communication with an inner surface of the central portion so as to wick fluid from the inner surface along the fibres. The wicking fibres are directed inwardly of the inner surface into the volume.

9 Claims, 5 Drawing Sheets

ABSORBENT BAND

CROSS REFERENCE TO RELATED APPLICATION

This application claims priority from United States Provisional Patent Application Ser. No. 60/113,960 filed Dec. 28, 1998 titled Absorbent Band.

FIELD OF THE INVENTION

This invention relates to an absorbent band for wrapping around the head, and more particularly relates to a reusable generally tubular, absorbent band which may be used to form an absorbent barrier below the hairline of the user to absorb excess caustic solutions applied to the hair of the user so as to protect the eyes, face and neck.

BACKGROUND OF THE INVENTION

In the cosmetology industry it is current practice when a person is receiving a hair permanent or having their hair dyed that prior to caustic solutions being applied to the hair, a length of cotton batting is wrapped around the hairline. This is to absorb excess caustic solution and thereby avoid solution running into the eyes or onto the face and neck of the person having their hair penned or dyed. This method unfortunately has several disadvantages. In particular, the cotton batting is non-reusable and thus the supply of cotton batting constantly has to be replaced. Further, once wetted, cotton batting is difficult to manipulate in that it readily disintegrates and does not retain moisture well so that if the wetted cotton batting is handled in order to, for example, reposition the cotton batting, quite often the solution absorbed in the cotton batting will be released. U.S. Pat. No. 5,133,371 which issued on Jul. 28, 1992 to Sivess for an Absorbent Beauty Coil provides a tubular cloth cover over cotton batting, the combination supplied as a roll from which lengths are cut for one-time use and disposal. The coil is wrapped around the hairline, over the ears of the user so as to keep the wrap in contact with the hair. This is disadvantageous as it interferes with the curlers and with treatment of the hair itself. Further, it may not, in applicant's view, be sufficiently tightenable around the head to hold the liquid and prevent dripping.

Applicant is also aware of prior art headband assemblies of the type such as that proposed in U.S. Pat. No. 3,388,708 which issued Jun. 18, 1968 to Hudson, in which a supporting gutter-like structure is provided to retain cotton batting around the hairline of the user. Another gutter-like structure for collecting excess hair solutions is proposed in U.S. Pat. No. 4,368,545, which issued on Jan. 18, 1983 to Seidman for a Face-Protecting Device. Seidman proposes to catch excess hair solution in a flexible gutter so that the solution may be drained off and discarded.

Applicant is aware of various other proposed means for absorbing excess hair solution such as taught by U.S. Pat. No. 3,050,071 which issued on Aug. 21, 1962 to Hall for a Hair Solution Absorber, U.S. Pat. No. 4,958,385 which issued on Sep. 25, 1990 to Rushton for a Hair Dressing Headband, and laid open Canadian Patent Application No. 2,108,345 filed by Nicholson on Oct. 13, 1993 for an Absorbent Head Wrap. These devices all seek to improve on the performance of the usual method of using cotton batting as described above, without the advantages of the present invention as hereinafter disclosed.

Applicant is also aware of U.S. Pat. No. 4,656,671, which issued Apr. 14, 1987 to Manges, for a Reusable Headband.

Manges discloses a reusable headband for protecting the wearer from eye injury when using hair permanent solution. The headband is comprised of a strip of terry cloth which has been folded over a short central strip of elastic and sewed to the elastic strip while the elastic strip is stretched so that upon relaxation of the elastic strip an accordion pleat is formed longitudinally along the central portion of the headband. The ends of the band are provided with Velcro™ hook and loop fasteners. A drawback of the Manges headband is the relative complexity of manufacture and that the elastic strip sewn into the Manges headband may have little resistance to caustic hair permanent solutions and hair dyes which may considerably shorten the effective life span of the headband. Further, because the Manges headband relies on the resiliency of an elastic strip to tighten the headband on the head of a user, it may be that if the user has a small head that the resiliency of the elastic strip may be insufficient to form a proper seal around the hairline, or that the pleating of the material may wrinkle to such an extent that a proper seal around the hairline is not formed.

SUMMARY OF THE INVENTION

The invention consists of a tube of non-stretch washable and reusable material preferably of cotton or a cotton polyester blend which when laid flat is in approximately the shape of an elongated rectangle having tapered ends. The strip of material may be formed into an absorbent band for use as a headband to absorb caustic hair permanent solutions used in the hair permanent process and to absorb caustic hair dyes. The tubular band is formed by folding the rectangle of material over absorbent filler such as polyester fibre fill, commercially available in sheet form, and sewing the free edges together to form an intermediately disposed central tube portion adjacent opposed tapered end portions. The central portion may be separated from the end portions by a stitched line therebetween.

In summary, the present invention is a reusable headband for absorbing hair permanent and neutralizing solutions, and the method of making and using same.

The headband has an outer, substantially non-resilient, elongate, flexible sleeve. The sleeve is fluid permeable and comprises an elongate central portion sized to fit around a user's head in snug circumferential frictional engagement around the user's forehead and nape so as to extend therebetween. The central portion is disposed between opposite elongate end portions.

A volume of a wicking fibre fill, in one preferred embodiment but without intending to be limiting, polyester fibre batting is mounted into the central portion so as to completely fill the central portion. The fibre fill is resiliently compressed within the central portion thereby forming the volume into a dense resilient, porous cushion. The wicking fibres of the fibre fill register in fluid transporting communication with an inner surface of the central portion so as to wick fluid from the inner surface along the fibres. The wicking fibres are directed inwardly of the inner surface into the volume. The end portions of the sleeve are left substantially unfilled, that is, at least partially unfilled, so as to facilitate releasable fastening of the end portions to each other. Releasable fastening may include knotting or other forms of tying (collectively referred to as knotting), or mechanical fasteners such as hook and loop or other such releasable fastening means.

In one preferred embodiment, the fibre fill is formed from a sheet of fibre fill material rolled so as to form an elongate column or tube or the like, collectively referred to as a column. The column is mounted into the central portion of the sleeve so as to be longitudinally co-extensive with the central portion and, due to the rolling of the fibre fill sheet, so as to align fibres of the fibre fill into a generally spiral pattern, when viewed in cross-section laterally across the column. Thus, the fibres spiral radially inward from the inner surface of the central portion of the sleeve. This provides a simple effective method of directing the wicking fibres of the fibre fill into a radially inward disposed direction to transport fluid from the outer sleeve into the absorbent cushioning core of the headband.

Advantageously, the central portion of the sleeve, when filled with the fill, forms a tube.

In one aspect of the present invention, the end portions of the sleeve are segregated from the central portion by stitching. The end portions may be tapered, again, to facilitate knotting of the ends together.

In a second aspect, the sleeve is made of woven cotton/polyester blend fabric having a generally rectangular shape when laid open and flat. The rectangle of fabric is formed into the sleeve or tube by a stitched seam along opposite edges of the rectangle.

Also forming part of the present invention is a method of mounting to a user's head, that is, of using, the reusable headbands of the present invention for absorbing hair permanent and neutralizing solutions.

The method includes, prior to application of hair permanent solution, the steps of:

(a) wetting and wringing out a first headband, (b) wrapping the first headband around the user's head in a first direction by placing the central portion of the first headband against the user's forehead, and tensioning the central portion of the first headband rearwardly and downwardly over ears of the user to the nape of the user so as to overlap the end portions of the first headband, (c) releasably fastening, as for example by knotting, the end portions of the first headband to one another.

The hair permanent solution may then be applied to the hair of the user while the user is sitting upright so that excess hair permanent solution is absorbed by the first headband.

The method of the present invention further includes, prior to application of neutralizing solution, the steps of:

(d) wetting and wringing out a second headband, (e) wrapping the second headband around the user's head in a second direction opposite to the first direction by placing the central portion of the second headband against the nape of the user and tensioning the central portion of the second headband forwardly and upwardly over the ears of the user to the forehead of the user so as to overlap the end portions of the second headband, (f) releasably fastening, as for example by knotting, the end portions of the second headband to one another.

The user's head may then be reclined over a washtub and the nape of the user comfortably rested against a rim of the washtub, cushioned by the second headband. The neutralizing solution may then be applied to the hair of the user so that excess neutralizing solution is absorbed by the second headband.

Also forming part of the present invention is a method of making the reusable headband according to the present invention. The method includes the steps of:

(a) forming an outer sleeve of substantially non-resilient, elongate, flexible, fluid permeable material and having an elongate central portion sized to fit around a user's head in snug circumferential frictional engagement around the user's forehead and nape so as to extend therebetween, the central portion disposed between oppositely disposed elongate end portions formed as part of the ends of the sleeve, (b) mounting a volume of a wicking fibre fill into the central portion so as to completely fill the central portion and so as to resiliently compress the fibre fill within the central portion thereby forming the volume into a dense resilient, porous cushion having wicking fibres of the fibre fill registering in fluid transporting communication with an inner surface of the central portion so as to wick fluid from the inner surface along the fibres, the wicking fibres disposed or directed inwardly of the inner surface into the volume, (c) leaving the end portions of the sleeve substantially unfilled so as to facilitate releasable fastening of the end portions to each other. If mechanical fasteners are to be used, they are secured to the end portions.

In one embodiment, the method further comprises the step of forming the fibre fill by rolling a sheet of fibre fill material so as to form an elongate column, and then mounting the column into the central portion of the sleeve so as to be longitudinally co-extensive with the central portion. This aligns fibres of the fibre fill into a generally spiral pattern, when viewed in cross-section laterally across the column, that is, the fibres spiral radially inward from the inner surface of the central portion of the sleeve.

Advantageously, the sleeve may take the form of a tube. The fibre fill may be polyester fibre batting rolled from sheets of such batting. The sleeve may be stitched so as to segregate the end portions from the central portion of the sleeve.

DETAILED DESCRIPTION OF PREFERRED EMBODIMENTS

A cotton or combination Cotton/Polyester sleeve is filled with polyester fibre fill. The fill acts as a wick to absorb permanent liquids, and reduces perm solution from dripping into a user's eyes and onto the face. The ends of the sleeve may be tied or otherwise releasably secured so as to snugly to gather the sleeve as an annular band around the head of the user. The headband can be used over and over again and eliminates the wasteful disposal of the cotton wads. It is quickly applied, a simple knot holds it firmly in place, and it is easily washed and dried along with a salon's towel wash and ready for re-use.

Figure 1:
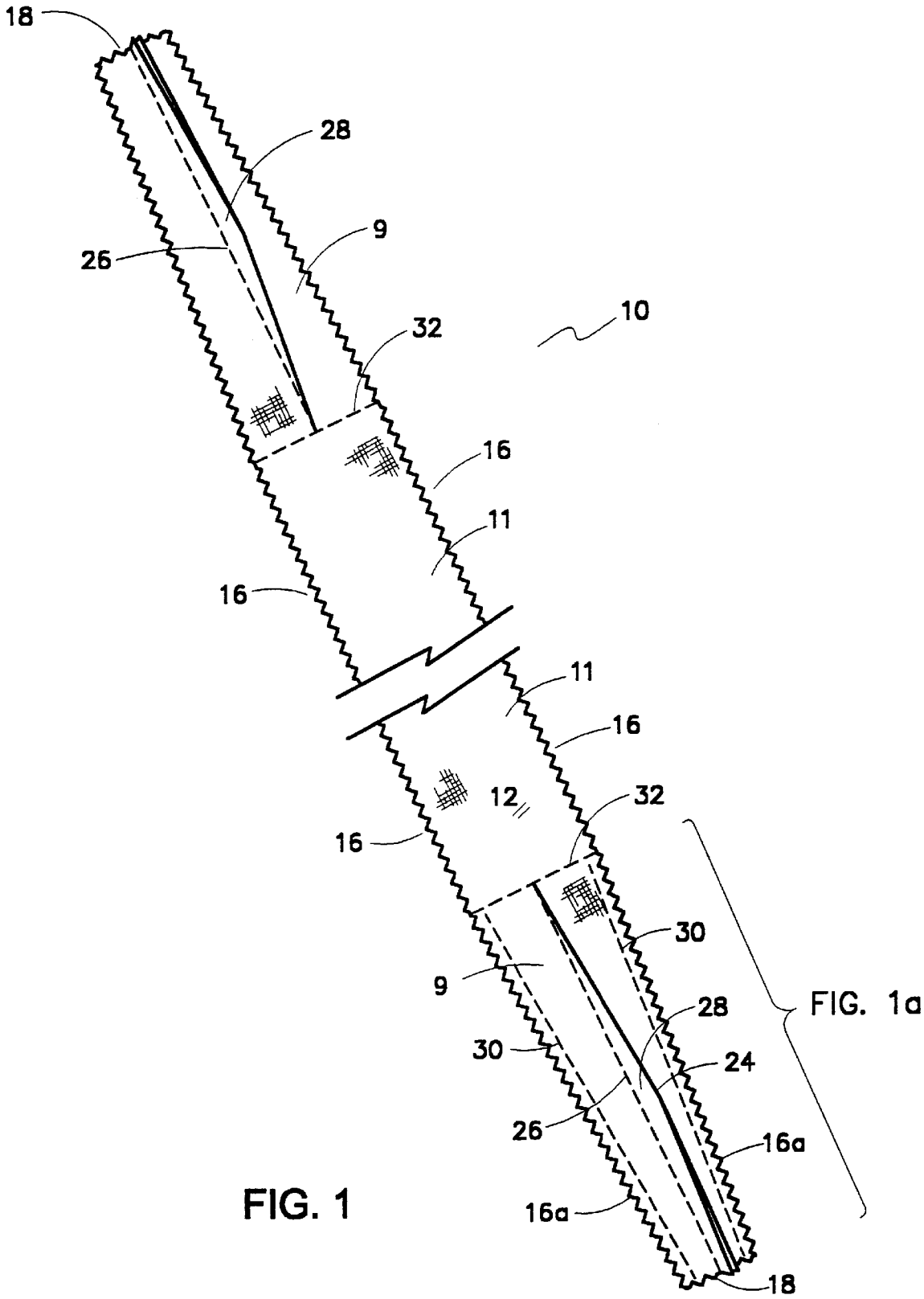
FIG. 1 is a partially cut-away plan view of a headband according to the present invention when the headband is laid flat and the filler removed.

FIG. 1 illustrates the sleeve as a substantially rectangular piece or strip of material as it appears when laid flat once it has been cut from a bolt of such material. The planform shape may be substantially rectangular, or elongatedly generally oval or elliptical so long as the longitudinal axis is significantly longer that the lateral axis. The material used in one preferred embodiment is cotton non-stretch cloth having in one embodiment an 80% cotton and a 20% polyester content. The material may be cloth diaper material, for example cotton flannel. Material having a total weight of approximately ½ ounce has been found to work well.

Figure 2:
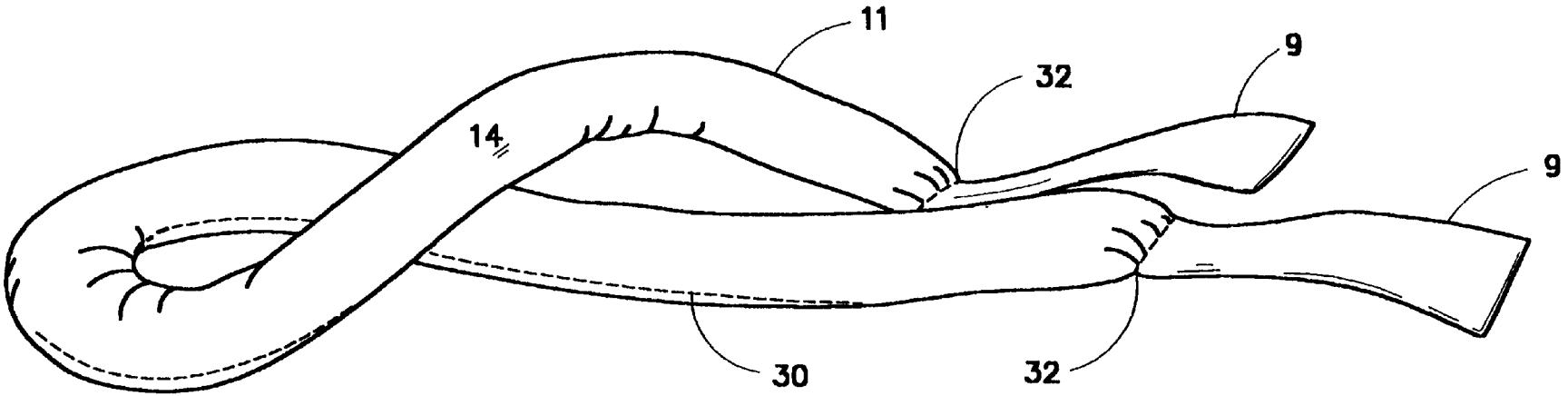
FIG. 2 is, in perspective view, a headband according to the present invention.
Figure 2A:
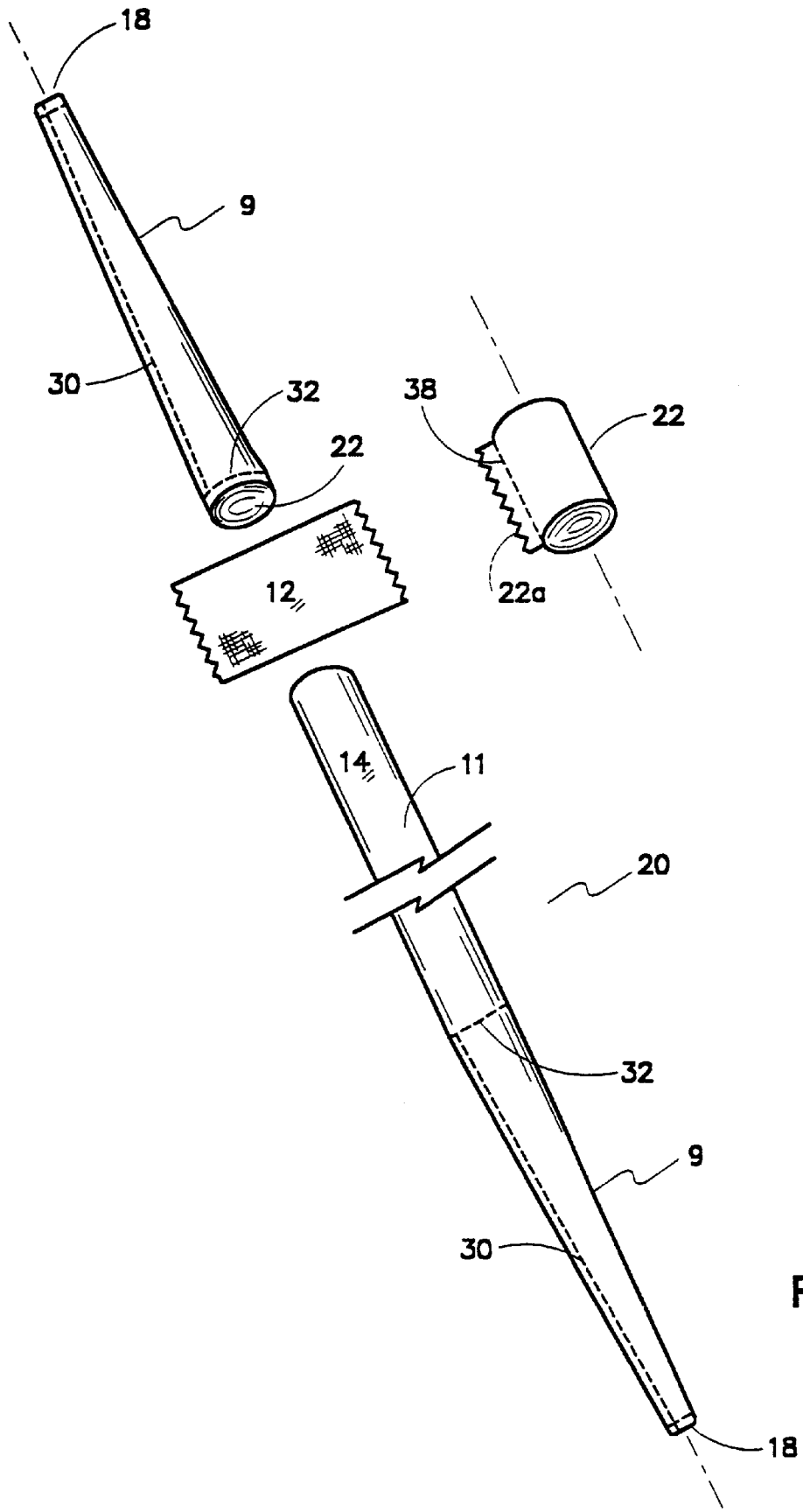
FIG. 2*a* is a partially cut-away, partially exploded, perspective view of the headband of FIG. 1, in its tubular form with a filler insert.

The preferred material, once wetted with hot water and wrung out, provides wicking of permanent solution through the sleeve material so as to transport the solution to a wetted filler inner core within the sleeve. This warm band applied to a user's head makes it comforting to the user and relaxing. Also when wet it clings to the user's head and moulds in place. Advantageously the filler core is of polyester fibre fill, commercially available in sheet form. A rectangle of such material may be rolled to form the filler core as seen in FIG. 2*a*. Once rolled, for ease of handling, the free edge of the roll may be sewn to form the roll prior to being wrapped in the outer cotton sleeve material.

Figure 1A:
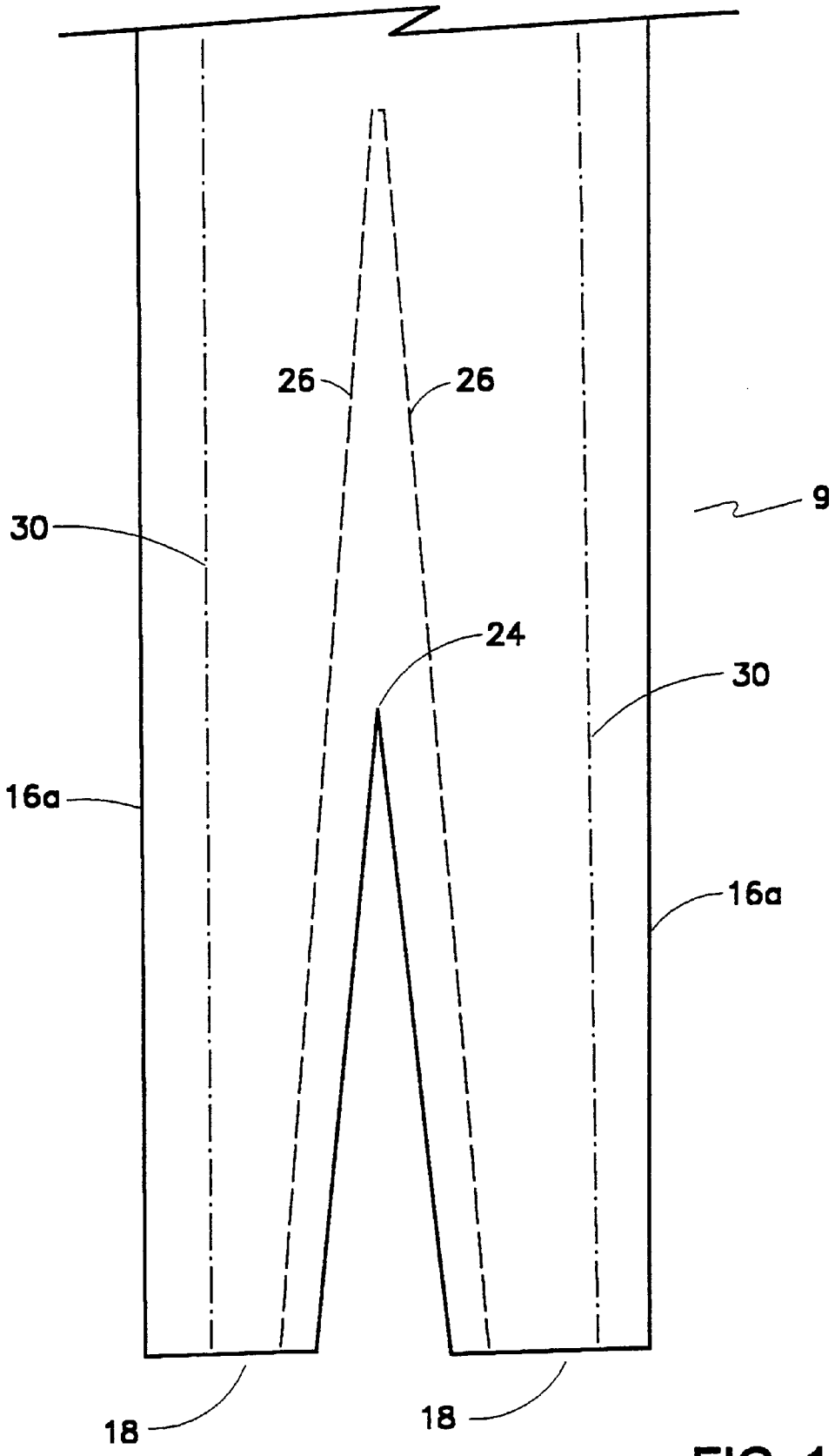
FIG. 1*a* is an enlarged exploded view of a tapered end of the headband of FIG. 1, exploded to illustrate a cut-out for forming the tapered end.

It has been found that useful dimensions for the strip of cotton cloth are approximately 4 inches perpendicular to the longitudinal axis, and approximately 27 inches along the longitudinal axis. Varying the lateral width of the strip of material will affect the maximum absorbent capacity of the headband, once formed as a tube and filled with absorbent filler. A wider strip of material will form a wider tube and therefore absorb a greater volume of hair permanent solution or hair dyes than a narrower strip. The ends may be cut to a tapered plan form, or a "V"-shaped cut-out such as seen in FIG. 1*a* may be employed and the pair of loose ends thereby formed sewn together to form the tapered end.

The length of the strip of material need only be such that it will wrap around the head of the user below the hairline so as to be fastened at its ends by tying of its ends 9 or by use of releasable fasteners such as hook and loop fasteners. As better described below the tapered ends of a first headband are knotted at the nape of the user's neck during the process of applying perm solution, and the tapered ends of a second headband (once the first headband is removed) knotted at the user's forehead during the process of neutralizing the perm solution, in the user's hair. As illustrated in FIG. 2, the tube may be formed as a segmented single cylindrical tube having tapered ends.

In the preferred embodiment, strip 10 of non-stretch cloth material is a cotton and polyester knit blend, wherein strip 10 when laid flat has an inner surface 12 and an outer surface 14. Strip 10 has longitudinal edges 16 and end edges 18. Although not necessary, edges 16 and ends 18 may be zigzag cut.

Strip 10 may thus be formed, as by sewing, into tube 20 as illustrated in FIG. 2. The cross-sectional cut-away of tube 20 exposes absorbent filler 22. Ends 18 may be tapered and segmented by a "V"-shaped cut-out from a central vertex position 24. Stitching along stitch line 26 assists forming the tapered end by gathering material into gather 28. The "V"-shaped cut-out removes excess material from gather 28 and may be cut after stitching along stitch line 26. Tube 20 is subsequently formed in the usual manner, for example, by stitching together of edges 16 and 16*a* along stitch lines 30 and 30*a* respectively. Whether or not tapered, ends 9 may be segmented from center section 11 of tube 20 by lateral lines of stitching 32. Ends 9 may be unfilled, partially filled with filler 22 or only filled adjacent lines of stitching 32 so as to leave the distal end portions of ends 9 un-filled, thereby facilitating ease of knotting together of ends 9.

In assembling tube 20, the following steps are taken. First, strip 10 is cut out so as to be rectangular in plan form. Edges 16 are then shown together along stitch line 30 and the resultant sleeve is turned inside-out so that the outside surface 14 of the central position of tube 20 has a clean tubular finish. The central portion is then filled with polyester fibre fill 22. To ease insertion of fibre fill 22, the fibre fill may be tightly rolled and the free edge 22*a* of the roll secured by stitching 38. If ends 9 are to be tapered, gather 28 is then formed by stitching along stitch line 26, and edges 16*a* folded over onto one another to enclose a small amount of fibre fill 22 protruding from the central portion of tube 20. The ends are sewn closed along stitch lines 30*a* and segmented from the central portion of tube 20 by stitching along lateral stitch lines 32.

Figure 3:
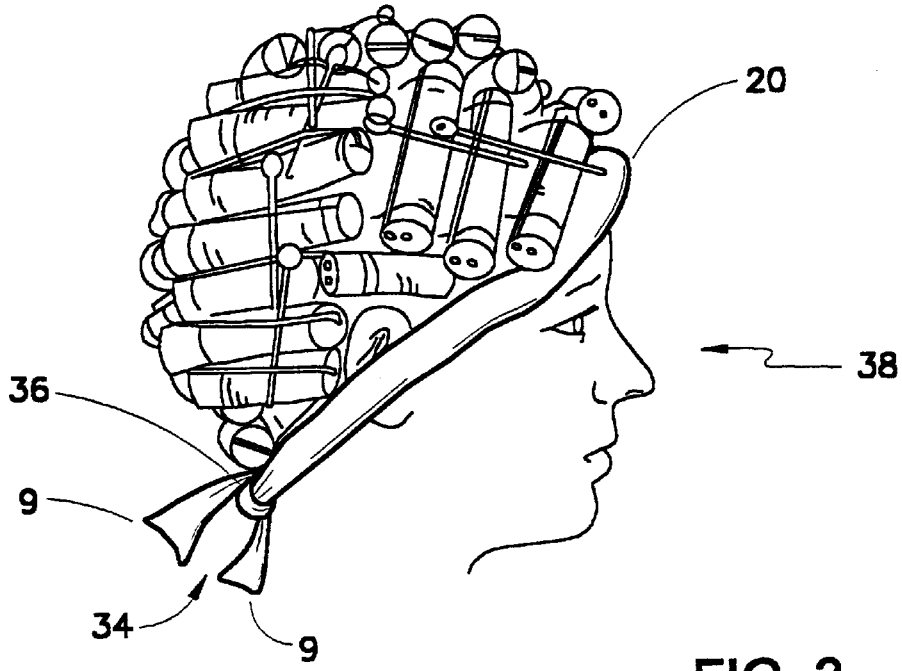
FIG. 3 is a side elevation view of the headband of FIG. 2 being worn during the perm liquid application process.
Figure 4:
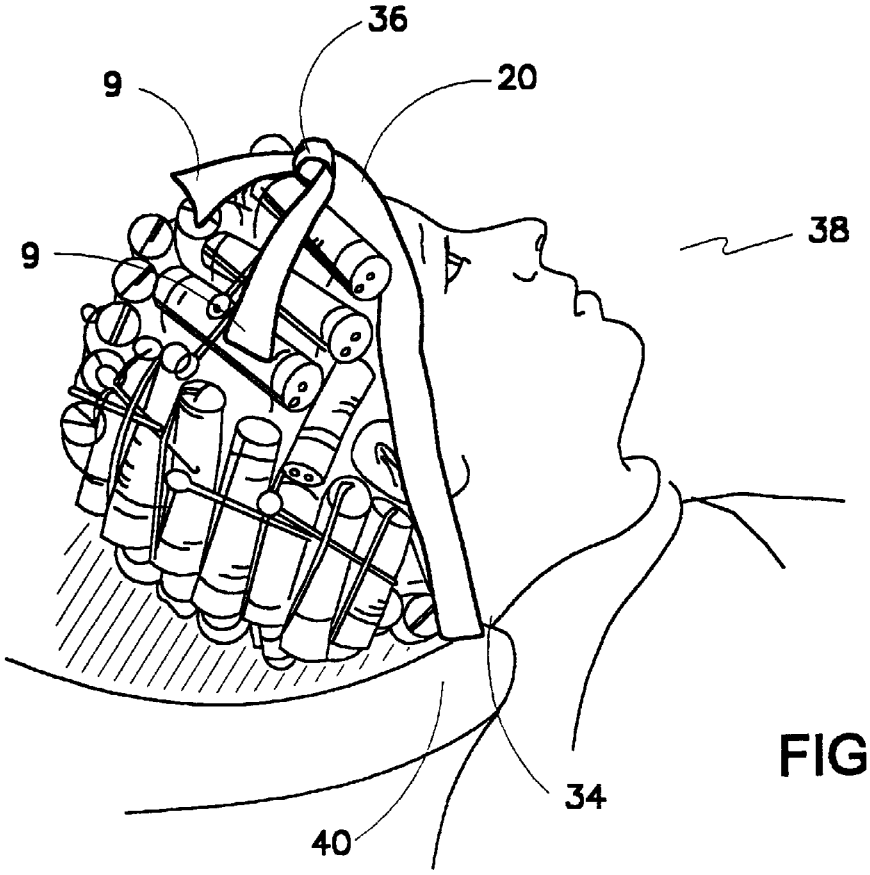
FIG. 4 is a side elevation view of a headband according to the present invention being worn in a reversed orientation about the head during the perm liquid neutralizing process.

In the present invention, during the process of applying perm solution to a user's hair, a first tube 20 is secured at the nape 34 of the user by tying ends 9 into a knot 36, as seen in FIG. 4, or by otherwise releasably fastening the ends together. Although not illustrated other than knotting, it is understood that tying, hook and loop, or other conventional releasable fasteners or closures may be used. Thus in FIG. 3 tube 20 is wrapped around the head of a user 34, below the hairline so as not to interfere with the curlers. Ends 18 of tube 20 are knotted together at nape 34, i.e. at the back of the user's neck, to releasably tightly fasten tube 20 around the head, so as to partly cover the ears and forehead of the user. More particularly, during the process of applying the perm solution, the hairdresser first wraps the perm as usual then wets a first headband according to the present invention with warm water, squeezing out excess water so as to start the wicking process between the sleeve material and the inner filler. The hairdresser stands behind user 38 and initially positions the headband so as to wrap around the forehead and ears of the user. The headband is stretched slightly by applying tension to the ends of the headband, there being a small amount of resiliency in the headband due to the wetting and inherent nature of the cotton or cotton/polyester sleeve 20. Stretching the headband assists in conforming the headband to the curves around the user's forehead, temple, ears and nape. Ends 9 are then secured by knot 36 snugly against nape 34. Permanent solution is then applied to the user's hair.

During the process of neutralizing the permanent solution in the user's hair, the first headband is put aside for washing, and a second headband according to the present invention wrapped in a reversed direction, that is, from nape 34 forward so as to be knotted at knot 36 snugly against the user's forehead. Sleeve 20, now provides a comfortable cushion between nape 34 and the rolled edge 40 of a wash basin so that user 38 is comfortable in a reclined position such as seen in FIG. 4 while neutralizing solution is applied to the hair. Once completed, both the first and second headbands may be rinsed and then washed along with other articles such as with the salons used towels. Once washed, the headbands may then be hung to dry or mechanically dried in a tumble dryer.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A reusable headband for absorbing hair permanent and neutralizing solutions, comprising:

an outer, substantially non-resilient, elongate, flexible sleeve, said sleeve fluid permeable and comprising an elongate central portion sized to fit around a user's head in snug circumferential frictional engagement around said user's forehead, nape and therebetween, said central portion disposed between opposite elongate end portions, a volume of a wicking fibre fill mounted into said central portion so as to completely fill said central portion and so as to resiliently compress said fibre fill within said central portion thereby forming said volume into a dense resilient, porous cushion having wicking fibres of said fibre fill registering in fluid transporting communication with an inner surface of said central portion so as to wick fluid from said inner surface along said fibres, said wicking fibres directed inwardly of said inner surface into said volume, said end portions of said sleeve substantially unfilled so as to facilitate releasable fastening of said end portions to each other, wherein said fibre fill is formed of a sheet of fibre fill material rolled so as to form an elongate tubular column said column, mounted into said central portion of said sleeve so as to be longitudinally co-extensive with said central portion and so as to align fibres of said fibre fill into a generally spiral pattern, when viewed in cross-section laterally across said column, said fibres spiralling radially inward from said inner surface of said central portion of said sleeve.

2. The headband of claim 1 wherein said fibre fill is polyester fibre batting.

3. The headband of claim 1 wherein said end portions are segregated from said central portion by stitching.

4. The headband of claim 3 wherein said end portions are tapered.

5. The headband of claim 1 wherein said sleeve is made of woven cotton/polyester blend fabric having a generally rectangular shape when laid open and flat and formed into said tube by a stitched scam along opposite edges of said rectangle.

6. The headband of claim 1 wherein said releasable fastening of said end portions is by knotting said end portions together.

7. A method of making a reusable headband for absorbing hair permanent and neutralizing solutions, comprising the steps of:

(a) forming an outer sleeve of substantially non-resilient, elongate, flexible fluid permeable material so that an elongate central portion is sized to fit around a user's head in snug circumferential frictional engagement around said user's forehead and nape so as to extend therebetween, and forming end portions oppositely disposed from ends of said central portion, (b) mounting a volume of a wicking fibre fill into said central portion so as to completely fill said central portion and so as to resiliently compress said fibre fill within said central portion thereby forming said volume into a dense resilient, porous cushion having wicking fibres of said fibre fill registering in fluid transporting communication with an inner surface of said central portion so as to wick fluid from said inner surface along said fibres, and directing, during said mounting, said wicking fibres inwardly of said inner surface into said volume, (c) leaving said end portions of said sleeve substantially unfilled so as to facilitate releasable fastening of said end portions to each other, (d) forming said volume of said fibre fill by rolling a sheet of fibre fill material so as to form an elongate tubular column, and mounting said column into said central portion of said sleeve so as to be longitudinally co-extensive with said central portion and so as to align fibres of said fibre fill into a generally spiral pattern, when viewed in cross-section laterally across said column, said fibres spiralling radially inward from said inner surface of said central portion of said sleeve.

8. The headband of claim 7 wherein said fibre fill is polyester fibre batting.

9. The method of claim 7 further comprising the step of stitching said sleeve so as to segregate said end portions from said central portion.

* * * * *